United States Patent [19]

Arata et al.

[11] Patent Number: 4,596,520

[45] Date of Patent: Jun. 24, 1986

[54] HERMETIC SCROLL COMPRESSOR WITH PRESSURE DIFFERENTIAL CONTROL MEANS FOR A BACK-PRESSURE CHAMBER

[75] Inventors: Tetsuya Arata; Takao Mizuno, both of Shimizu, Japan

[73] Assignee: Hitachi, Ltd., Tokyo, Japan

[21] Appl. No.: 678,487

[22] Filed: Dec. 5, 1984

[30] Foreign Application Priority Data

Dec. 14, 1983 [JP] Japan ..... 58-234408
Oct. 11, 1984 [JP] Japan ..... 59-211326

[51] Int. Cl.[4] ..... F04C 18/04; F04C 29/02

[52] U.S. Cl. ..... 418/55; 418/57; 418/94

[58] Field of Search ..... 418/55, 57, 94, 98

[56] References Cited

FOREIGN PATENT DOCUMENTS 55-148994 11/1980 Japan .
57-76291 5/1982 Japan ..... 418/57
58-160580 9/1983 Japan ..... 418/57
58-160583 9/1983 Japan ..... 418/57
58-183887 10/1983 Japan ..... 418/57

*Primary Examiner*—John J. Vrablik

*Attorney, Agent, or Firm*—Antonelli, Terry & Wands

[57] ABSTRACT

A hermetic scroll compressor having a motor-driven compressor unit mounted in a hermetic housing and constituted by a scroll compressor section and a driving electric-motor section which are drivingly connected to each other through a rotary shaft supported by a bearing on a frame fixed in the housing. The scroll compressor section has a stationary scroll member and an orbiting scroll member having meshing wraps for defining compression chambers therebetween. The pressure of the fluid under compression is introduced into a back pressure chamber formed behind the orbiting scroll member so as to produce an axial thrust which presses the orbiting scroll member onto the stationary scroll member. A lubricating oil collected in the bottom portion of the hermetic housing is sucked up and delivered through a passage formed in the rotary shaft by the pressure differential between the high discharge pressure and the intermediate pressure acting in the back pressure chamber. In order to ensure the safe supply of the lubricating oil regardless of the operating condition of the compressor, a control valve device is provided for selectively establishing a communication between the suction side of the compressor and the back-pressure chamber.

13 Claims, 15 Drawing Figures

HERMETIC SCROLL COMPRESSOR WITH PRESSURE DIFFERENTIAL CONTROL MEANS FOR A BACK-PRESSURE CHAMBER

BACKGROUND OF THE INVENTION

The present invention relates to a scroll compressor suitable for use in, for example, refrigerators and air-conditioners and, more particularly, to a hermetic scroll compressor having a control valve capable of ensuring a stable supply of lubricating oil to the bearings of the compressor.

In general, a scroll compressor for use in a refrigerator or an air-conditioner has a motor-driven compressor unit composed of a scroll compressor section and a driving electric motor section which are coupled to each other through a rotary shaft supported by a frame. The motor-driven compressor unit as a whole is housed in a hermetic housing such that the compressor section overlies the motor section. The compressor has an orbiting scroll member having a disc-shaped end plate and a spiral wrap protruding uprightly therefrom and a stationary scroll member having a similar construction. The stationary scroll member has a discharge port and a suction port respectively formed in a central portion and a peripheral portion of the end plate thereof. Both scroll members are assembled together such that their wraps mesh with each other. A suction pipe is extended through the hermetic housing and connected to the suction port. An Oldham's mechanism is disposed between the orbiting scroll member and the frame so as to prevent the orbiting scroll member from rotating about its own axis. An eccentric shaft portion, provided on the upper end of the rotary shaft, engages with the orbiting scroll member such that the rotation of the rotary shaft causes an orbiting movement of the eccentric shaft portion which, in turn, causes an orbiting motion of the orbiting scroll member without allowing the orbiting member to rotate about its own axis. Consequently, the volume of closed compression chambers, formed by the wraps of both scroll members, is progressively decreased so that the gas confined in these chambers is progressively compressed and is discharged through the discharge port into a discharge chamber formed in the closed housing. The compressed gas is then introduced into the motor chamber which is formed in the lower portion of the housing. The lubricating oil suspended by the compressed gas is separated from the gas as the flow of the gas collides with, for example, the stationary part of the motor and the gas having no oil content is discharged to the outside of the compressor through a discharge pipe connected to the closed housing.

During the operation of this scroll compressor, the gas under compression produces a force which acts to urge both scroll members axially away from each other thus tending to form an axial gap between the axial ends and cooperating surfaces of the end plates of both scroll members. Consequently, the compressed gas in the compression chamber under higher pressure is allowed to escape into the compression chambers under lower pressure so that the compression performance of the compressor is impaired.

In order to overcome this problem, it has been proposed to apply a gas pressure to the back side of the orbiting scroll member such as to press the orbiting scroll member axially into close contact with the stationary scroll member. For instance, Japanese Patent Laid-Open No. 148994/1980 discloses an arrangement in which the intermediate pressure between the suction pressure and the discharge pressure is introduced into a back pressure chamber formed behind the end plate of the orbiting scroll member so as to produce the axial pressing force and thus attaining a tight seal between both scroll members.

The lubricating oil is collected in an oil pan formed in the bottom of the closed housing and is sucked therefrom by the pressure differential between the high pressure in the closed vessel and the intermediate pressure in the back-pressure chamber through an oil passage formed in the rotary shaft. The oil thus sucked is distributed to various parts requiring lubrication such as bearings.

A problem of this conventional scroll compressor, resides in the fact that the pressure at which the lubricating oil is supplied is reduced below a predetermined critical oil supply pressure in dependence on the operating condition of the compressor, particularly, when the compression ratio (ratio of discharge pressure to suction pressure) is low, for the reasons which will be described later.

SUMMARY OF THE INVENTION

Accordingly, an object of the invention is to provide an improved scroll compressor which prevents the lubricating oil supply pressure from being reduced below a predetermined critical pressure even under an operating condition with a low compression ratio, thereby ensuring safe lubrication of the bearings.

To this end, according to the invention, a scroll compressor of the type described, comprises a valve means for selectively providing communication between the back-pressure chamber and the suction chamber. More specifically, this valve means operates to provide a communication between the back-pressure chamber and the suction chamber such as to reduce the pressure in the back-pressure chamber, when the pressure differential between the discharge chamber and the back-pressure chamber is reduced below a predetermined positive level, thus maintaining the lubricating oil pressure above the critical oil supply pressure.

When the compressor is operating at a high compression ratio, the discharge pressure is sufficiently higher than the suction pressure and the pressure in the back-pressure chamber, so that the force acting on a pressure-receiving surface of the valve means, to which the discharge pressure is applied, is large enough to overcome the counter force produced by the pressure in the back-pressure chamber, whereby the scroll compressor operates in the same way as the conventional scroll compressor with the back-pressure chamber and the suction chamber disconnected from each other.

On the other hand, during operation at a low compression ratio, as in the cases of the cooling operation of an air-conditioner at low air temperature defrosting of an evaporator during the heating operation of an air-conditioner and low-speed operation of an air-conditioner driven by an inverter, the difference between the discharge pressure and the pressure in the back-pressure chamber is reduced below the predetermined positive level so as to reduce the lubricating oil supply pressure below the critical oil supply pressure and the above-mentioned valve means operates to reduce the pressure in the back-pressure chamber thereby maintaining an oil supply pressure higher than the critical oil supply pressure, thus ensuring the safe supply of the lubricating oil to the bearings of the compressor.

The above and other objects, features and advantages of the invention will become clear from the following description of the preferred embodiments when the same is read in conjunction with the accompanying drawings;

DETAILED DESCRIPTION

Figure 1:
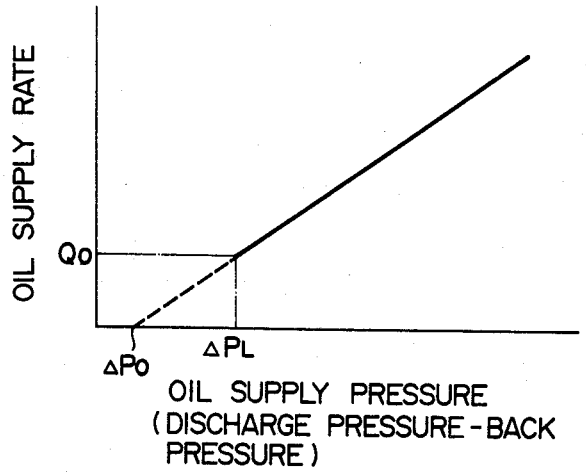
FIG. 1 is a graphical illustration of a relationship between a change in a rate of supply of lubricating oil with respect to a change in the lubricating oil supply pressure.

Referring now to the drawings wherein like reference numerals are used throughout the various views to designate like parts and, more particularly, to FIG. 1, as shown in this figure, in the hermetic scroll compressor of the kind described hereinbefore, the rate of supply of the lubricating oil to the bearings of the compressor is changed in proportion to the pressure differential between the discharge pressure and the pressure in the back-pressure chamber. This pressure differential will be referred to as "oil supply pressure" in this specification. When the oil supply pressure is reduced below a certain level $\Delta P$, the rate of oil supply is reduced to zero due to the head or height difference between the bearings and the oil level in the oil pan and due to the flow resistance along the oil passage. Therefore, in order to maintain the oil supply rate above the required level $Q_0$, it is necessary to maintain the oil pressure above a predetermined level $\Delta P_L$. This level of oil supply pressure will be referred to as "critical oil supply pressure" in this specification.

Figure 2:
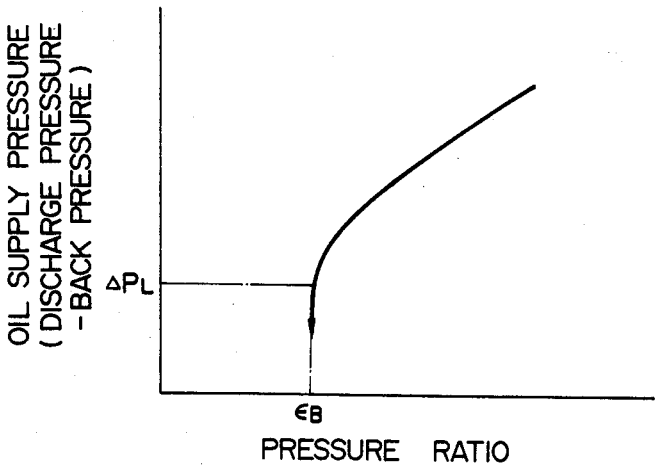
FIG. 2 PRIOR ART
FIG. 2 is a graphical illustration of a relationship between the compression ratio and the oil supply pressure in a conventional scroll compressor.

FIG. 2 shows how the oil supply pressure is changed in relation to the compression ratio (ratio of discharge pressure to suction pressure) as observed in the conventional scroll compressor. Therefore, it is often experienced that the required oil supply pressure fails due to a too high pressure in the back-pressure chamber, particularly when the compressor is operating with a low compression ratio, i.e., at a comparatively high suction pressure and a comparatively low discharge pressure. In FIG. 2, a symbol $\epsilon_B$ shows the lower limit of the pressure ratio for attaining the required level of oil supply pressure in the conventional hermetic scroll compressor. Namely, when the compression ratio becomes lower than this level $\epsilon_B$, the oil supply pressure is reduced below the critical limit value $\Delta P_L$ so that the supply of lubricating oil is impaired such as to cause accidents such as a seizure in the bearings.

This problem is particularly serious in the case where the hermetic scroll compressor is driven by an inverter. Namely, when the compressor is driven by an inverter, the speed of the compressor varies over a wide range from a low speed of about 30 Hz to a high speed of 60 Hz or higher. Because of the possibility of fine control of the speed, the compressor driven by an inverter operates even at such a light load condition that an ordinary hermetic scroll compressor for constant speed operation would not work. The speed of the compressor of this type is very low when the load is small and, therefore, the compression ratio is too small to ensure the critical oil supply pressure.

On the other hand, Japanese Patent Laid-Open Nos. 76291/1982 and 160583/1983 propose measures for preventing any extraordinary pressure rise in the back-pressure chamber. More specifically, according to Japanese Patent Laid-Open No. 76291/1982, the back-pressure chamber is brought into communication with the suction chamber to reduce the pressure therein thus decreasing the axial pressing force produced by the back pressure, when the force produced by the pressure in the back-pressure chamber is increased to exceed the sum of the force produced by the suction pressure and the force produced by a spring. On the other hand, Japanese Patent Laid-Open No. 160583/1983 proposes allowing the back-pressure chamber to be communicated with the discharge chamber so as to reduce the pressure in the back-pressure chamber when the force produced by the back pressure increases beyond the sum of the force produced by the discharge pressure and the force of a spring.

These proposals, however, are unsatisfactory from the view point of lubrication of bearings, although they are effective in eliminating other problems attributable to an extraordinary pressure rise in the back-pressure chamber.

The problems concerning the supply of lubricating oil encountered by the conventional hermetic scroll compressor can be overcome by the present invention as will be realized from the following description.

Figure 3:
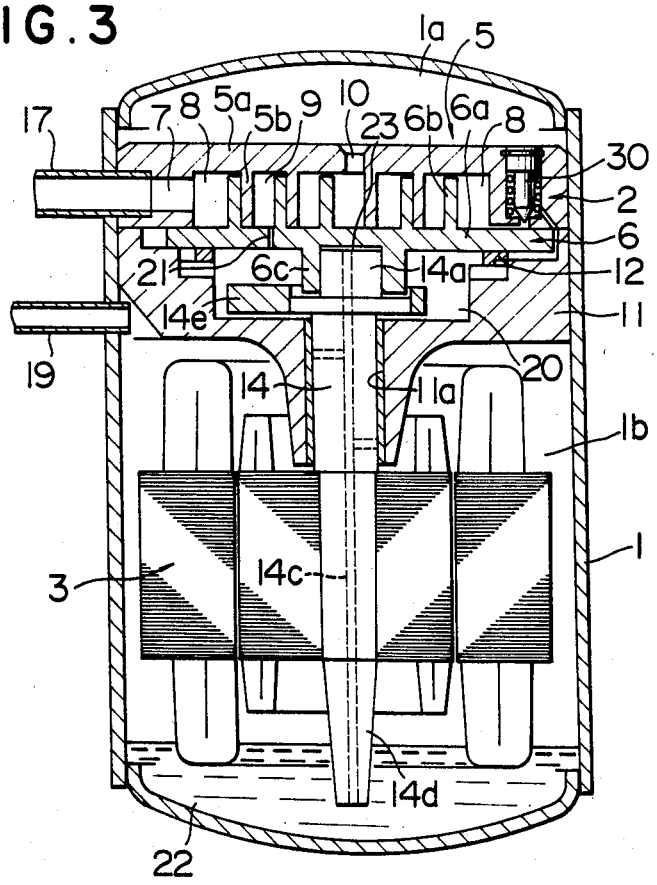
FIG. 3 is a vertical sectional view of an embodiment of a hermetic scroll compressor in accordance with the invention.

As shown in FIG. 3 a first embodiment of the hermetic scroll compressor in accordance with the invention includes a compressor section 2 and an electric motor section 3 which are provided in a hermetic housing 1. The compressor section 2 includes a stationary scroll member 5 and an orbiting scroll member 6 which mesh with each other to form closed compression chambers 9 therebetween. The stationary scroll member 5 has a disc-shaped end plate 5*a* and a wrap 5*b* protruding upright from the end plate 5*a* and having a configuration following an involute curve or a curve approximating an involute curve. A discharge port 10 and a suction port 7 are respectively formed in the central and peripheral regions of the end plate 5*a*. The orbiting scroll member 6 has a disc-shaped end plate 6*a*, a wrap 6*b* formed on one side of the end plate 6*a* and having a contour conforming with that of the wrap 5*b* of the stationary scroll member 5, and a boss 6*c* formed on the other side of the end plate 6*b*. The boss 6*c* has a hole which receives an eccentric shaft portion 14*a* formed on a rotary shaft 14 such that the rotation of the rotary shaft 14 causes an orbiting movement of the eccentric shaft portion and, hence, of the orbiting scroll member 6. The rotary shaft 14 is rotatably supported by a bearing 11*a* provided on a central portion of a frame 11. The stationary scroll member 5 is fixed to the frame 1 by a plurality of bolts, not shown, while the orbiting scroll member 6 is carried by the frame 11 through a Oldham's mechanism 12 constituted by an Oldham's ring and an Oldham's key. The orbiting scroll member 6, therefore, can make an orbiting movement with respect to the stationary scroll member 5 without rotating about its own axis. The rotary shaft 14 is connected at its lower end to an electric motor of the electric motor section 3. A suction pipe 17 is extended through the wall of the hermetic housing 1 and connected to the suction port 7 formed in the stationary scroll member 5. The discharge port 10 opens to a discharge chamber 1*a* which, in turn, is communicated with a lower chamber 1*b* through a passage, not shown, and further leads to a discharge pipe 19 which penetrates the wall of the hermetic housing 1.

A space 20 constituting a back-pressure chamber is defined by the rear or back surface of the orbiting scroll member 6 and the frame 11. An intermediate pressure between the suction pressure (pressure of the low-pressure side) and the discharge pressure is applied to this back-pressure chamber so as to produce an axial thrust force for maintaining the orbiting scroll member in close contact with the stationary scroll member, overcoming the axial force produced by the gas under compression in the compression chambers between both scroll members and tending to separate the orbiting scroll member 6 from the stationary scroll member 5. The intermediate pressure is introduced into the back-pressure chamber through a small aperture 21 formed in the end plate 6*a* of the orbiting scroll member 6.

A lubricating oil passage bore 14*c* extending through the rotary shaft, has a lower end opening in the lower end of the rotary shaft and an upper end opening in the top surface of the eccentric shaft portion 14*a*. The lower end 14*b* of the rotary shaft 14 is immersed in the lubricating oil 22 accumulated in an oil pan formed in the bottom of the hermetic housing 1. A balance weight 14*e* is formed as a unit with the rotary shaft 14 at the lower end portion of the eccentric shaft portion 14*a* above a main bearing which opposes the end surface of the boss 6*c* of the orbiting scroll member 6.

A valve means generally designated at a numeral 30 has the function of selectively establishing communication between the suction chamber 8 and the back-pressure chamber 20 in accordance with the pressure differential between the discharge chamber 1*a* and the back-pressure chamber 20.

Figure 4:
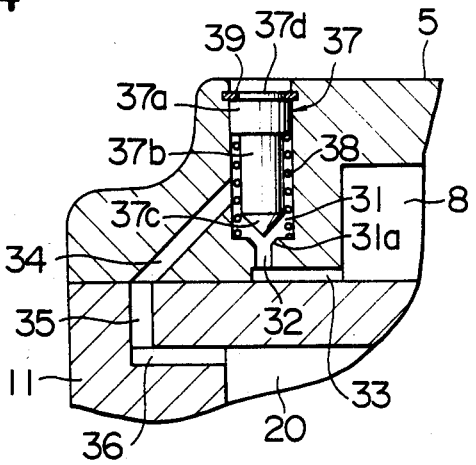
FIG. 4 is an enlarged sectional view of an essential portion of the hermetic scroll compressor shown in FIG. 3, showing particularly the portion around a control valve.

As shown most clearly in FIG. 4, a cylindrical axial valve chamber 31 is formed in a peripheral portion of the stationary scroll member 5. The bottom of the valve chamber 31 is communicated with the suction chamber 8 through a small bore 32 extending from the bottom of the valve chamber 31 and then through a radial passage 33 leading from the end of the bore 32. The step formed at the juncture between the valve chamber 31 and the small bore 32 constitutes a valve seat 31*a*. A communication bore 34 leads from a lateral side obliquely downwardly and communicates with the back-pressure chamber 20 through passages 35 and 36 which are formed in the frame 11. A valve member, disposed in the valve chamber 31, has a stepped cylindrical portion and a conical portion. The large-diameter portion 37*a* of the valve member 37 fits in the valve chamber 31 so as to slide therealong, while the small-diameter portion 37*b* is surrounded by a spring 38. The small-diameter portion 37*b* is connected at its lower end to a conical portion 37*c*. The valve member 37 as a whole is urged by the spring 38 such that the conical portion 37*c* is kept away from the valve seat 31*a*. The movement of the valve member 37 is stopped by a stopper ring 39.

The upper end surface of the valve member 37 constitutes a pressure-receiving surface 37*d* to which the discharge pressure is applied while the pressure in the back-pressure chamber 20 is introduced into the valve chamber 31 through the passages 35 and 36.

The arrangement is such that, when the force produced by the discharge pressure acting on the pressure-receiving surface 37*d* exceeds the sum of the force produced by the pressure of the back-pressure chamber 20 acting in the valve chamber 31 and the force of the spring 38, the valve member 37 is urged downwardly to bring the conical portion 37*c* into contact with the valve seat 31*a* thus interrupting the communication between the back-pressure chamber 20 and the suction chamber 8.

Conversely, when the force produced by the discharge pressure acting on the pressure receiving surface 37*d* is exceeded by the sum of the force produced by the pressure in the back-pressure chamber and the force of the spring 38, the valve member 37 is raised, as illustrated in FIG. 4, thus establishing the communication between the back-pressure chamber 20 and the suction chamber 8.

In operation, the rotary shaft 14 is directly driven by the electric motor 3 so that the eccentric shaft portion 14*a* makes an eccentric orbiting motion which, in turn, causes an orbiting movement of the orbiting scroll member 6. As a result, the closed compression chambers 9, formed between both scroll members 5, 6, are progressively moved towards the center of the scroll members 5, 6 while their values are reduced. As a result, the gas, for example, a refrigerant gas, is introduced into the suction chamber 8 in the peripheral part of the stationary scroll member 5 through the suction pipe 17 and the suction port 7 and is compressed progressively until it is discharged into the discharge chamber through the discharge port 10. The compressed gas of high temperature and pressure is then introduced into the lower chamber 1*b* and is discharged to the outside through the discharge pipe 19.

During the operation of this hermetic scroll compressor, the lubricating oil is supplied to the bearings in a manner explained hereinunder.

The lower end 14*d* of the rotary shaft 14, in which is to be found the lower end of the oil passage bore 14*c*, is immersed in the lubricating oil 22 in the bottom of the hermetic housing under the influence of the high discharge pressure Pd, while the portion around the boss 6*c* of the orbiting scroll member 6 is maintained at the intermediate pressure Pm, so that the lubricating oil ascends through the oil passage bore 14*c* due to the pressure differential Pd−Pm. A part of the lubricating oil thus coming up through the rotary shaft 14 is supplied to the bearing 11*a* through radial passage bores communicating with the oil passage bore 14*c*, while the remainder of the lubricating oil is discharged into the closed space 23 between the upper end surface of the eccentric shaft portion 14*a* and the bottom surface of the bore formed in the boss 6*c* of the orbiting scroll member 6. This closed space 23 will be referred to as an "oil pressure chamber", hereinunder. The lubricating oil in the oil pressure chamber 23 is maintained at a pressure substantially the same as the discharge pressure Pd. The lubricating oil reaching the bearing in the boss 6*c* and the bearing 11*a* is discharged into the back-pressure chamber 20 through respective bearing gaps. The lubricating oil then lubricates various sliding parts such as the Oldham's mechanism 12 and is injected into the compression chambers 9 through the minute apertures mentioned above so as to be mixed with the refrigerant gas under compression.

The lubricating oil is then discharged through the discharge port 10 into the discharge chamber 1*a* and then flows into the lower chamber 1*b* together with the compressed gas. In the lower chamber 1*b*, the lubricating oil is separated from the gas and drips into the oil pan formed in the bottom of the hermetic housing.

The lubricating oil supply provided in the above-described manner is conducted only during normal operation of the compressor in which the discharge pressure is sufficiently high as compared with the suction pressure. Namely, in this state, the force produced by the discharge pressure acting on the pressure-receiving surface 37*d* of the valve means 30 is large enough to exceed the sum of the force produced by the intermediate pressure derived from the back-pressure chamber 20 and acting in the valve chamber 31 and the force of the spring 38, so that the valve member 37 is depressed such as to close the opening in the valve seat 31*a* with its conical portion 37*c*, thus interrupting the communication between the back-pressure chamber 20 and the suction chamber 8. The lubricating oil is, therefore, recirculated in the above-explained manner.

The pressure in the back-pressure chamber 20 is generally governed by the suction pressure. Namely, the pressure in the back-pressure chamber 20 is increased as the suction presure increases. When the air-conditioner is operating in the cooling mode at low air-temperature or when the air-conditioner is operating for defrosting of an evaporator in the heating mode, the discharge pressure is comparatively low while the suction pressure is comparatively high, i.e., the compression ratio is rather small. In such a case, the pressure in the back-pressure chamber 20 is increased correspondingly so that the sum of force produced by the pressure derived from the back-pressure chamber 20 and the force produced by the spring 38 becomes large enough to exceed the force produced by the pressure in the discharge chamber 1*a*. Consequently, the valve member 37 is urged to move the conical portion 37*c* away from the valve seat 31*a* thus establishing a communication between the back-pressure chamber 20 and the suction chamber 8, so that the gas in the back-pressure chamber 20 is released to the suction chamber 8 thereby reducing the pressure in the back-pressure chamber 20. Consequently, the oil supply pressure, i.e., the pressure differential between the discharge pressure and the pressure in the back-pressure chamber 20, is maintained at a sufficiently high level to ensure a supply of the lubricating oil to the bearings. Thus, during operation at a small compression ratio with comparatively high suction pressure and comparatively low discharge pressure, when the oil supply pressure approaches the aforementioned critical oil supply pressure, the valve means 30 operates to reduce the pressure in the back-pressure chamber 20 so as to maintain the oil supply pressure above the level of the critical oil supply pressure.

The valve means 30 has a spring 38 which acts to assist the force produced by the pressure in the valve chamber 31 derived from the back-pressure chamber 20, i.e., in the direction for urging the valve member 37 towards the discharge chamber. The described behavior of the valve member 37, therefore, is ensured despite the fact that the pressure differential is a positive one developed between a high discharge pressure and the low pressure derived from the back-pressure chamber, provided that the absolute value of the pressure differential exceeds a predetermined set value. For instance, the valve means 30 may be so adjusted as to operate to establish the communication whenever the compression ratio between the discharge pressure and the suction pressure is reduced below 2.0.

Figure 5:
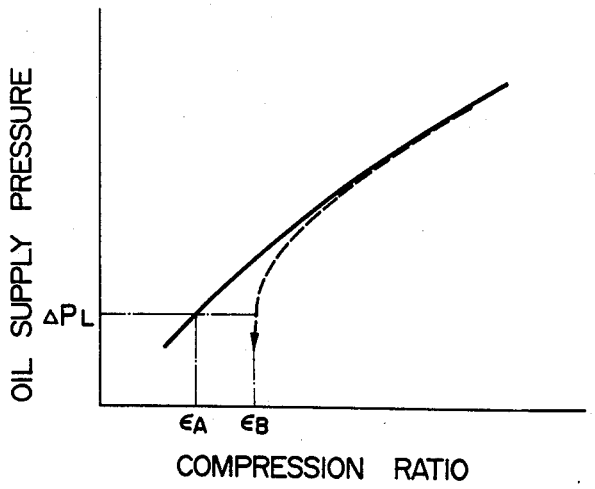
FIG. 5 is a graphical illustration of a relationship between the oil supply pressure and the compression ratio in the hermetic scroll compressor shown in FIGS. 2 and 3.
Figure 6:
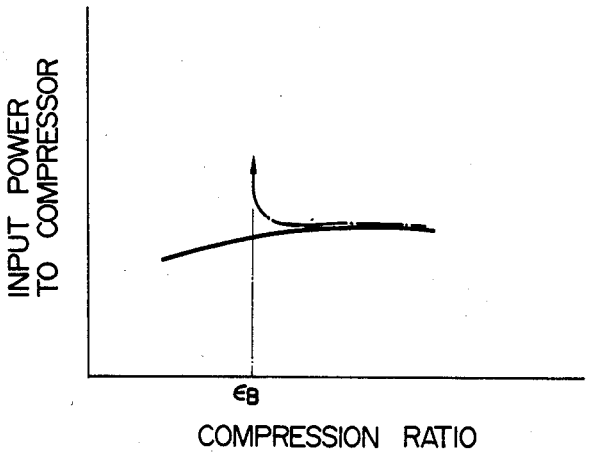
FIG. 6 is a graphical illustration of a relationship between the input power to the compressor and the compression ratio in the hermetic scroll compressor shown in FIGS. 2 and 3.

Referring to FIGS. 5 and 6, wherein the broken lines indicate values obtained with a conventional hermetic scroll compressor, $\epsilon_B$ represents the lower limit of the compression ratio in the conventional compressor. When the compression ratio is reduced below this level, the oil supply pressure is decreased to a level below the limit level $\Delta P_L$ so that the input power to the compressor motor is increased drastically due to insufficient lubrication of the bearings. A long running of the compressor under such condition causes serious troubles such as seizure of in the bearings.

In the case of an air-conditioner driven by an inverter, the speed of the compressor is decreased as the cooling load becomes smaller. Consequently, the suction pressure is increased while the discharge pressure is decreased, namely, the compression ratio is reduced. Since the pressure in the back-pressure chamber 20 is increased as a result of the rise of the suction pressure, the lubricating oil supply pressure, i.e., the pressure differential between the discharge pressure and the pressure in the back-pressure chamber 20, is decreased correspondingly. On the other hand, the force produced by the discharge pressure acting on the valve member 37 is decreased and, as this force is reduced below a predetermined set level, the valve member 37 is raised to open the passage 32 thus allowing the back-pressure chamber 20 to be communicated with the suction chamber 8. Consequently, the pressure in the back-pressure chamber 20 is decreased so that an oil supply pressure high enough to supply the bearings with the lubricating oil is maintained even when the compression ratio is reduced to a level below the limit $\epsilon_B$ for the conventional hermetic scroll compressor. Thus, according to the invention, the compression ratio may be reduced down to a limit $\epsilon_A$ which provides the critical oil supply pressure $\Delta P_L$. The value $\epsilon_A$ is determined by factors such as the flow resistance along the passage between the back-pressure chamber 20 and the suction chamber 8, and can have any desired value exceeding 1.0. As will be seen from FIG. 5, in the hermetic scroll compressor of the invention, oil supply pressure high enough to ensure the oil supply to the bearings can be maintained even when the compression ratio is reduced to a level much lower than the limit for the conventional hermetic scroll compressor. Due to the adequate oil supply, any undesirably drastic increase in the input power to the compressor motor is avoided, as will be seen from FIG. 6.

The critical oil supply pressure $\Delta P_L$ may vary slightly, depending on the construction of the bearing. In the case of the compressor of the described embodiment, the critical oil supply pressure $\Delta P_L$ is preferably in a range of between 0.1 MPa and 0.3 MPa (Mega Pascal).

Figure 7:
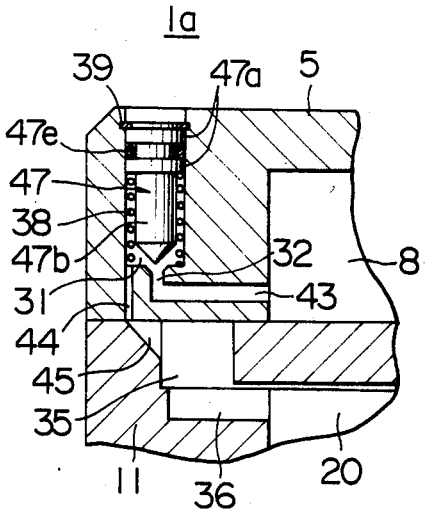
FIG. 7 is a vertical sectional view of another embodiment of the present invention showing particularly the control valve thereof.

The embodiment of FIG. 7 differs from the first embodiment in that an "O" ring 47*e* is provided between the peripheral surface of one end portion of the enlarged portion 47*a* of the valve member 47 and the wall defining the valve chamber 31, thus attaining a tight seal therebetween, and in that the passage 43 between the small bore 32 presenting the valve seat in the valve chamber 31 and the suction chamber 8, as well as the passages 44 and 45 between the valve chamber 31 and the back-pressure chamber 20, has a specific construction.

In the embodiment of FIG. 7, a tight seal is formed by the "O" ring 47*e* between the large-diameter portion 47*a* of the valve member and the wall of the valve chamber 31. The operation of the valve member 47 is identical to that of the first embodiment of FIG. 4.

Figure 8:
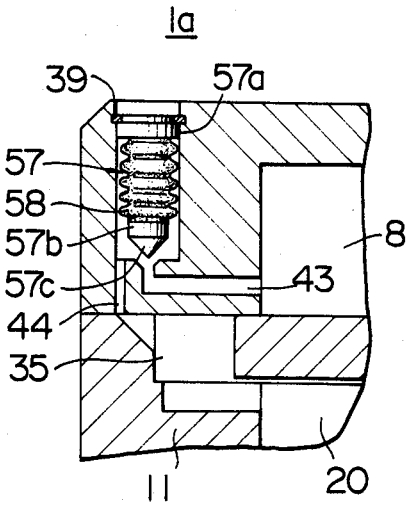
FIG. 8 is a vertical sectional view of still another embodiment of the present invention showing particularly the control valve thereof.

The embodiment of FIG. 8 is distinguished from the embodiment shown in FIG. 7 only with respect to the construction of the valve member. Namely, the valve member 57 of the embodiment of FIG. 8 is constituted by a large-diameter portion 57*a* and a valve head which is constituted by a conical portion 57*c* and a small-diameter portion 57*b*. The valve head is connected to the large-diameter portion 57*a* through a bellows 58 which is resilient and adapted to keep the valve head away from the valve seat as in the preceding embodiments. The valve member 57 operates in the same manner as those of the embodiments explained before in connection with FIGS. 4 and 7 such as to ensure a sufficiently high oil supply pressure.

Figure 9:
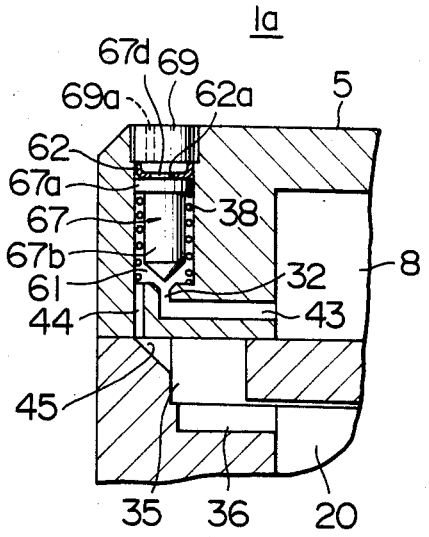
FIG. 9 is a vertical sectional view of a further embodiment of the present invention showing particularly the control valve thereof.

The embodiment of FIG. 9 is distinguished from the embodiment shown in FIG. 7 in that a disc-shaped stopper plug 69, having a through bore 69*a*, is fitted in the open end of the valve chamber 61 and a saucer-shaped seal disc 62 made of a rubber or a plastic is disposed between the stopper plug 69 and the valve body 67. The seal disc 62 plays the same role as the "O" ring in the embodiment shown in FIG. 7.

In the embodiment of FIG. 9, the saucer-shaped seal disc 62 makes a sliding sealed contact at its peripheral portion with the wall of the valve chamber 61 and contacts, at its central portion, with the pressure-receiving surface 67*d* of the large-diameter portion 67*a* of the valve member 67. The seal disc 62 moves together with the valve member 67 in response to the discharge pressure applied to the valve member 67, while sealing the discharge chamber 1*a* from the valve chamber 61 without fail.

The valve member 67 operates in the same manner as in the preceding embodiments, thus ensuring the required oil supply pressure.

Figure 10:
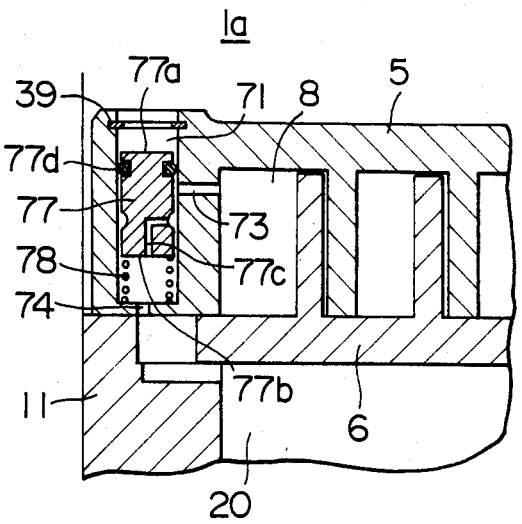
FIG. 10 is a vertical sectional view of a still further embodiment of the present invention showing particularly the control valve thereof.
Figure 11:
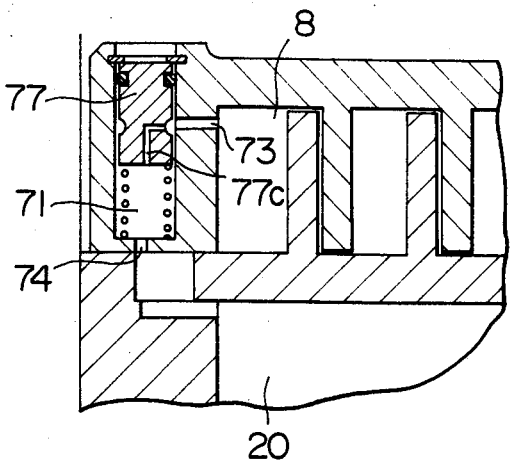
FIG. 11 is a vertical sectional view illustrating the operation of a valve member of the control valve of the embodiment of FIG. 10.

In FIGS. 10 and 11, the valve means includes a valve chamber 71 formed in the stationary scroll member 5, a valve member 77 disposed in the valve chamber 71, a spring 78 and a stopper ring 39 for preventing the valve member from coming off. The valve chamber 71 communicates at its upper portion with the discharge chamber 1*a*, while the lower part of the same is communicated with the back-pressure chamber 20 through a bore 74. The valve chamber 71 is further communicated at its intermediate portion thereof with the suction chamber 8 through a bore 73. The upper end surface of the valve member 77 presents a pressure-receiving surface 77*a* for receiving the pressure derived from the discharge chamber 1*a*, while the lower end surface of the same constitutes a pressure-receiving surface 77*b* for receiving the presure derived from the back-pressure chamber 20. The valve member 77 is provided with an internal passage bore 77*c* which leads from the pressure-receiving surface 77*b* to a lateral side of the valve member 77. An "O" ring 77*d* is fitted around the upper portion of the valve member 77 for sealing purposes. The spring 78 is loaded between the pressure-receiving surface 77*b* of the valve member 77 and the bottom wall of the valve chamber 71, while the stopper ring 39 is fitted in a ring groove formed in the wall of the valve chamber 71 so as to prevent the valve member 77 from coming off.

In operation, when the difference between the forces exerted by the pressure acting on both pressure-receiving surfaces of the valve member 77 is greater than the force of the spring 38, the valve member 77 is moved to a position where it interrupts the communication between the communication bore 77*c* and the bore 73 as shown in FIG. 10. However, when the difference in the forces mentioned above is reduced below the force of the spring 78, the spring 78 urges the valve member 77 to the position shown in FIG. 11 where the valve member 77 allows the communication between the communication bore 77*c* and the bore 73, i.e., between the back-pressure chamber 20 and the suction chamber 8.

Figure 12:
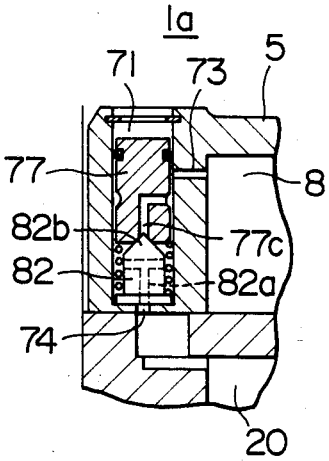
FIG. 12 is a vertical sectional view of a still further embodiment of the present invention showing particularly the control valve thereof.
Figure 13:
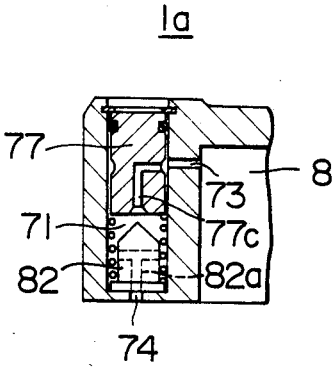
FIG. 13 is a vertical sectional view illustrating the operation of the valve member of the control valve of the embodiment of FIG. 12.

The embodiment of FIGS. 12 and 13 is distinguished from the embodiment shown in FIGS. 10 and 11 by the following features. Namely, in the embodiment of FIGS. 12 and 13, an auxiliary valve member 82 is fixed to the bottom wall of the valve chamber 71. The auxiliary valve member 82 is provided with an internal communication bore 82*a* through which the valve chamber 71 is communicated with the bore 74. FIG. 12 shows the valve member 77 in the position where it interrupts the communication between the back-pressure chamber 20 and the suction chamber 8. Namely, in this state, the communication bore 77*c* in the valve member 77 is blocked by a conical portion 82*b* of the auxiliary valve member 82. When the difference between the forces produced by the pressures acting on respective pressure-receiving surfaces becomes smaller than the spring 78, the valve member 77 is moved upwardly to allow the communication bore 77*c* to communicate with the bore 73, as shown in FIG. 13.

According to the embodiment of FIGS. 12 and 13, when the valve member 77 is moved downwardly due to a large pressure differential between the discharge chamber 1*a* and the back-pressure chamber 20, the auxiliary valve member 82 blocks the communication bore 77*c* in the valve member 77 so that the communication between the back-pressure chamber 20 and the suction chamber 8 is interrupted without fail.

Figure 14:
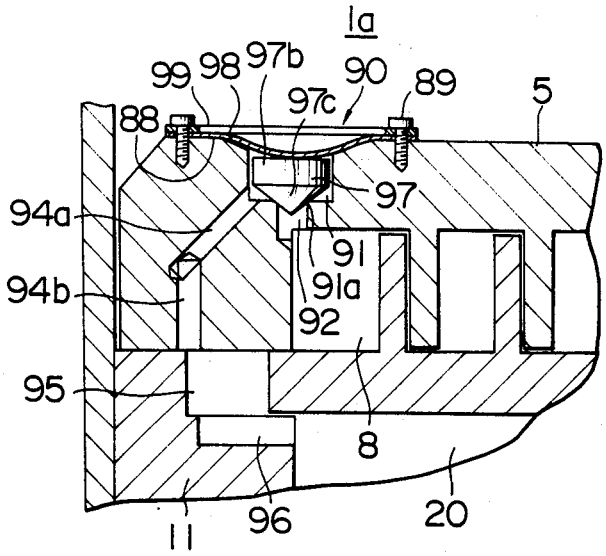
FIG. 14 is a vertical sectional view of a still further embodiment of the present invention showing particularly the control valve thereof.
Figure 15:
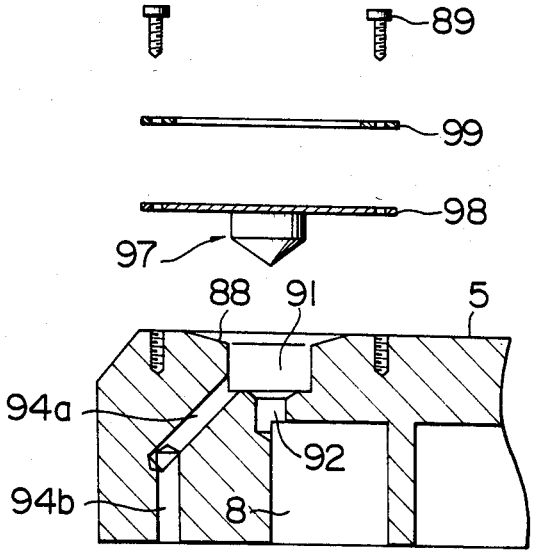
FIG. 15 is an exploded view of the control valve in the embodiment of FIG. 14.

In FIGS. 14 and 15 valve means 90 employs a valve member constituted by a valve head and a leaf spring to which the valve head is attached. A cylindrical valve chamber 91, of a suitable depth, is formed in the stationary scroll member 5 as to extend from the outer wall portion of the stationary scroll member 5. The valve chamber 91 is communicated at its bottom with the suction chamber 8 through an axial small bore 92. The step presented by the juncture between the valve chamber 91 and the small bore 92 provides a valve seat 91*a*. A passage bore 94*a* is extended obliquely downwardly from the periphery of the bottom portion of the valve chamber 91 and is connected to an axial communication bore 94*c* which, in turn, is communicated with the back-pressure chamber 20 through passages 94 and 96 formed in the frame 11. The valve chamber 91 receives a valve member 97 having a disc portion 97*b* provided at its end with a conical portion 97*c*. This valve member is fixed to the central portion of a circular leaf spring 98 and is secured to the stationary scroll member 5 by means of a plurality of bolts 89 together with an annular retainer plate 99. The portion of the stationary scroll member 5 around the opening of the valve chamber 91 is recessed as at 88 in conformity with the curvature of the leaf spring 98 in the deflected state.

In operation, the pressure derived from the discharge chamber 1*a* is applied to the upper surface of the leaf spring 98, while the pressure derived from the back-pressure chamber 20 is introduced into the valve chamber 91. During normal running in which the discharge pressure is sufficiently high compared with the suction pressure, the sum of the force produced by the pressure from the back-pressure chamber and the force produced by the leaf spring 98 is less than the force produced by the discharge pressure, so that the leaf spring 98 is pressed and deflected as illustrated to bring the conical portion 97*c* of the valve member into engagement with the valve seat 91*a* thus interrupting the communication between the back-pressure chamber and the suction chamber 8. However, when the compression ratio is small, the difference of the force acting against the force of the leaf spring 98 is so small that the sum of the force produced by the pressure derived from the back-pressure chamber 20 and the resetting force of the leaf spring 98 exceeds the force produced by the discharge pressure acting on the upper side of the leaf spring 98, so that the leaf spring resumes its original state and thus moves the valve member 97 and hence the conical portion 97*c* away from the valve seat 91*a* whereby the valve seat 91*a* is opened.

Therefore, the back-pressure chamber 20 is communicated with the suction chamber 8 so that the pressure in the back-pressure chamber 20 is lowered so a to increase the oil supply pressure, i.e., the pressure differential between the discharge pressure and the pressure in the back-pressure chamber 20, thus ensuring the lubricating oil supply to the bearings.

In this embodiment, since the force of the leaf spring 98 acts to assist the force produced by the pressure derived from the back-pressure chamber 20, the valve member 97 operates with a positive pressure differential, as in the case of the embodiment explained before in connection with FIG. 4. It will be clear to those skilled in the art that the level of the positive pressure differential for actuating the valve member can be adjusted suitably by selecting the spring constant of the leaf spring 98.

Although the invention has been described through specific forms, it is to be noted here that the described embodiments are only illustrative and various changes and modifications may be imparted thereto without departing from the scope of the invention which is limited solely by the appended claims.

What is claimed is:

1. A hermetic scroll compressor having: a hermetic housing; a frame fixed in said housing; and a motor-driven compressor unit mounted in said housing, said motor-driven compressor unit having a scroll compressor section and an electric motor section which are drivingly connected to each other through a rotary shaft supported by a bearing carried by said frame, said scroll compressor section including a stationary scroll member and an orbiting scroll member each having an end plate and a spiral wrap protruding uprightly from one side of said end plate and said scroll members being assembled together such that their wraps mesh with each other so as to form closed compression chambers between said wraps, said orbiting scroll member engaging with an eccentric shaft portion formed on one end of said rotary shaft, means provided between the orbiting scroll member and the stationary scroll member for preventing a rotation of said orbiting scroll member about its own axis, said stationary scroll member being respectively provided at its central and peripheral portions with a discharge port and a suction port, the orbiting movement of said orbiting scroll member causing a movement of said compression chambers towards a center of said stationary scroll member while progressively decreasing the volumes of said compression chambers thereby compressing a gas confined in the compression chambers until the gas is discharged through said discharge port into a space in said hermetic housing and then to an outside of said compressor through a passage so that a high pressure is maintained in said space in said hermetic housing, said compressor section further having a back-pressure chamber defined between said orbiting scroll member and said frame to which is introduced an intermediate pressure of the gas in a course of compression so as to produce an axial thrust force which tends to press said orbiting scroll member onto said stationary scroll member, said compressor section further having a lubricating means adapted to supply a lubricating oil to bearings by a pressure differential between the high pressure maintained in said space and said hermetic housing and the pressure in said back-pressure chamber, and wherein a control valve means is provided which is adapted to establish a communication between said back pressure chamber and said suction chamber when the pressure differential between the pressure in said discharge chamber and the pressure in said back-pressure chamber is below a predetermined positive level.

2. A hermetic scroll compressor according to claim 1, wherein said control valve means includes a valve member adapted to receive at respective ends thereof the discharge pressure and the back pressure, so that the pressures act on said valve member in opposite directions, and a means for actuating said valve member when said pressure differential has reached said predetermined positive level.

3. A hermetic scroll compressor according to claim 2, wherein said actuating means includes a spring adapted to urge said valve member towards said discharge chamber.

4. A hermetic scroll compressor according to claim 2, wherein said actuating means includes a bellows having a resilient force for urging the valve member towards said discharge chamber.

5. A hermetic scroll compressor according to claim 1, wherein said valve means includes a valve chamber opening in the outer wall of said stationary scroll member, said valve chamber having a valve seat formed in the lower portion thereof and communicating with said suction chamber, and passage means opening to a lateral side of said valve chamber communicating said valve chamber with said back-pressure chamber; a valve member accommodated in said valve chamber; and a spring means for urging said valve member toward said discharge chamber.

6. A hermetic scroll compressor according to claim 5, wherein said valve member is received in said valve chamber leaving a sealing gap between itself and the wall of said valve chamber thus sealing the inside of said valve chamber from said discharge chamber.

7. a hermetic scroll compressor according to claim 5, wherein said valve member has a sealing "O" ring fitted thereto.

8. A hermetic scroll compressor according to claim 1, wherein said valve means includes a valve chamber formed in said stationary scroll member so as to open in the outer wall of said stationary scroll member, aperture means in a valve seat formed in a lower portion of said valve chamber for communicating said valve chamber with said back-pressure chamber and also with said suction chamber through a passage opening in a lateral side thereof; a valve member received in said valve chamber and having an internal communication bore leading from the bottom to a lateral side thereof; and a spring adapted for urging said valve member toward said discharge chamber.

9. A hermetic scroll compressor according to claim 8, wherein said communication bore in said valve member and said passage opening in the lateral side of said valve chamber are communicated with each other when the valve member has been moved towards said discharge chamber.

10. A hermetic scroll compressor according to claim 9, wherein said valve member has a sealing "O" ring fitted thereto.

11. A hermetic scroll compressor according to claim 9, said valve means further includes an auxiliary valve member disposed in the bottom portion of said valve chamber and having a conical upper end and a bore for communication between said valve chamber and said back presure chamber, said conical upper end of said auxiliary valve member being adapted to block the communication bore in said valve member when said valve member has been moved towards said discharge chamber.

12. A hermetic scroll compressor according to claim 1, wherein said valve means includes a valve chamber formed in said stationary scroll member and opening in the outer wall of said stationary scroll member, aperture means in a valve seat formed in a lower portion of said valve chamber for communicating said valve chamber with said suction chamber and also with said back pressure chamber through a passage opening in a lateral side of said valve chamber; and a valve member received in said valve chamber and having a circular spring fixed to the upper end thereof, said spring being loaded to produce a force for urging said valve member towards said discharge chamber and fixed to the wall of said valve chamber in such a way so as to seal said valve chamber from said discharge chamber.

13. A hermetic scroll compressor according to claim 12, wherein said valve member has a conical lower end.

* * * * *